US012122496B2

(12) United States Patent
Malouf et al.

(10) Patent No.: US 12,122,496 B2
(45) Date of Patent: Oct. 22, 2024

(54) SYSTEM AND METHOD FOR CONTROLLING POSITION OF A MARINE DRIVE

(71) Applicant: Brunswick Corporation, Mettawa, IL (US)

(72) Inventors: Travis C. Malouf, Germantown, WI (US); Matthew W. Snyder, Fond du Lac, WI (US); Jason S. Arbuckle, Horicon, WI (US)

(73) Assignee: Brunswick Corporation, Mettawa, IL (US)

( * ) Notice: Subject to any disclaimer, the term of this patent is extended or adjusted under 35 U.S.C. 154(b) by 357 days.

(21) Appl. No.: 17/584,193

(22) Filed: Jan. 25, 2022

(65) Prior Publication Data

US 2022/0144401 A1 May 12, 2022

Related U.S. Application Data

(63) Continuation-in-part of application No. 16/922,787, filed on Jul. 7, 2020, now Pat. No. 11,235,847.

(51) Int. Cl.

| | |
|---|---|
| ***B63H 20/12*** | (2006.01) |
| ***B63H 20/00*** | (2006.01) |
| ***B63H 20/10*** | (2006.01) |

(52) U.S. Cl.

CPC ..... *B63H 20/12* (2013.01); *B63H 20/10* (2013.01); *B63H 2020/003* (2013.01)

(58) Field of Classification Search

CPC ... B63H 20/12; B63H 20/10; B63H 2020/003
See application file for complete search history.

(56) References Cited

U.S. PATENT DOCUMENTS

| | | | |
|---|---|---|---|
| 4,632,049 | A | 12/1986 | Hall et al. |
| 4,767,867 | A | 8/1988 | Georgiev et al. |
| 4,872,857 | A | 10/1989 | Newman et al. |
| 4,908,766 | A | 3/1990 | Takeuchi |
| 5,385,110 | A | 1/1995 | Bennett et al. |
| 6,085,684 | A | 7/2000 | Cotton |

(Continued)

FOREIGN PATENT DOCUMENTS

| | | |
|---|---|---|
| JP | 2010143322 | 7/2010 |

OTHER PUBLICATIONS

European search report dated Dec. 6, 2021 in counterpart European Patent Application 21182371.1.

*Primary Examiner* — Stephen P Avila
(74) *Attorney, Agent, or Firm* — Andrus Intellectual Property Law, LLP

(57) ABSTRACT

A method of controlling at least one marine drive on a marine vessel includes determining that a trim position sensor has failed for a first marine drive, determining an allowable steering angle range for the first marine drive based on a first assumed trim position, and determining a steering position adjustment based on the allowable steering angle range. A steering actuator is controlled to automatically adjust the steering position of the marine drive based on the steering position adjustment. A trim position adjustment is determined based on a second assumed trim position for the marine drive and a trim actuator is controlled to adjust the trim position of the first marine drive based on the trim position adjustment.

22 Claims, 10 Drawing Sheets

(56) References Cited

U.S. PATENT DOCUMENTS

| | | | | |
|---|---|---|---|---|
| 6,234,853 | B1 | 5/2001 | Lanyi et al. | |
| 6,322,404 | B1 | 11/2001 | Magee et al. | |
| 7,267,068 | B2 | 9/2007 | Bradley et al. | |
| 7,416,456 | B1 | 8/2008 | Gonring et al. | |
| 7,467,595 | B1 | 12/2008 | Lanyi et al. | |
| 7,497,746 | B2 | 3/2009 | Okuyama | |
| 8,818,587 | B1 | 8/2014 | Arbuckle et al. | |
| 9,290,252 | B1 | 3/2016 | Tuchscherer et al. | |
| 9,381,989 | B1 | 7/2016 | Poirier | |
| 9,751,605 | B1 | 9/2017 | Anschuetz et al. | |
| 9,919,781 | B1 | 3/2018 | Andrasko et al. | |
| 10,518,856 | B2 | 12/2019 | Andrasko et al. | |
| 2005/0272322 | A1* | 12/2005 | Mizuguchi ..... | B63H 20/12 440/61 R |
| 2007/0276563 | A1 | 11/2007 | Kaji | |
| 2010/0151750 | A1 | 6/2010 | Ito | |
| 2014/0329422 | A1 | 11/2014 | Ito | |
| 2016/0068247 | A1 | 3/2016 | Morvillo | |
| 2018/0050779 | A1 | 2/2018 | Anschuetz | |

* cited by examiner

SYSTEM AND METHOD FOR CONTROLLING POSITION OF A MARINE DRIVE

CROSS REFERENCE TO RELATED APPLICATION

This application is a continuation-in-part of U.S. patent application Ser. No. 16/922,787, filed Jul. 7, 2020, the contents of which is hereby incorporated by reference in its entirety.

FIELD

The present disclosure relates to marine vessels, and more particularly to systems and methods for controlling trim angle and steering position of marine drives on a marine vessel.

BACKGROUND

The disclosure of U.S. Pat. No. 4,872,857 is hereby incorporated herein by reference and discloses systems for optimizing operation of a marine drive of the type whose position may be varied with respect to the boat by the operation of separate lift and trim/tilt means.

The disclosure of U.S. Pat. No. 6,322,404 is hereby incorporated herein by reference and discloses a Hall effect rotational position sensor is mounted on a pivotable member of a marine propulsion system and a rotatable portion of the rotational position sensor is attached to a drive structure of the marine propulsion system. Relative movement between the pivotable member, such as a gimbal ring, and the drive structure, such as the outboard drive portion of the marine propulsion system, cause relative movement between the rotatable and stationary portions of the rotational position sensor. As a result, signals can be provided which are representative of the angular position between the drive structure and the pivotable member.

The disclosure of U.S. Pat. No. 7,416,456 is hereby incorporated herein by reference and discloses an automatic trim control system that changes the trim angle of a marine propulsion device as a function of the speed of the marine vessel relative to the water in which it is operated.

The disclosures of U.S. Pat. Nos. 6,234,853; 7,267,068; and 7,467,595 are hereby incorporated herein by reference and disclose methods and apparatuses for maneuvering multiple engine marine vessels.

The disclosure of U.S. Pat. No. 9,290,252 is hereby incorporated herein by reference and discloses systems and methods for controlling trim position of a marine propulsion device on a marine vessel. The system comprises a trim actuator having a first end that is configured to couple to the marine propulsion device and a second end that is configured to couple to the marine vessel. The trim actuator is movable between an extended position wherein the marine propulsion device is trimmed up with respect to the marine vessel and a retracted position wherein the marine propulsion device is trimmed down with respect to the marine vessel. Increasing an amount of voltage to an electromagnet increases the shear strength of a magnetic fluid in the trim actuator thereby restricting movement of the trim actuator into and out of the extended and retracted positions and wherein decreasing the amount of voltage to the electromagnet decreases the shear strength of the magnetic fluid thereby facilitates movement of the trim actuator into and out of the extended and retracted positions. A controller is configured to adapt the amount of voltage to the electromagnet based upon at least one condition of the system.

The disclosure of U.S. Pat. No. 9,381,989 is hereby incorporated herein by reference and discloses a method for positioning a drive unit on a marine vessel that includes receiving an initiation request from a user input device to operate the marine vessel in a desired operating mode and storing a first trim position of the drive unit in a memory upon receiving the initiation request. The method includes trimming the drive unit to a second trim position in response to the initiation request and subsequently operating the marine vessel in the desired operating mode with the drive unit in the second trim position. The method includes receiving a termination request to cancel the desired operating mode and trimming the drive unit to the first trim position automatically upon receiving the termination request. A system for positioning the drive unit is also disclosed.

The disclosure of U.S. Pat. No. 9,751,605 is hereby incorporated herein by reference and discloses a method for controlling a trim system on a marine vessel that includes receiving an actual trim position of a trimmable marine device at a controller and determining a trim position error by comparing the actual trim position to a target trim position with the controller. The method also includes determining an acceleration rate of the marine vessel. In response to determining that the trim position error exceeds a first error threshold and the magnitude of the acceleration rate exceeds a given rate threshold, the controller commands the marine device to the target trim position. In response to determining that the trim position error exceeds the first error threshold and the acceleration rate does not exceed the given rate threshold, the controller commands the marine device to a set point trim position that is different from the target trim position. An associated system is also disclosed.

The disclosure of U.S. Pat. No. 9,919,781 is hereby incorporated herein by reference and discloses systems and methods for controlling position of a trimmable drive unit with respect to a marine vessel. A controller determines a target trim position as a function of vessel or engine speed. An actual trim position is measured and compared to the target trim position. The controller sends a control signal to a trim actuator to trim the drive unit toward the target trim position if the actual trim position is not equal to the target trim position and if at least one of the following is true: a defined dwell time has elapsed since a previous control signal was sent to the trim actuator to trim the drive unit; a given number of previous control signals has not been exceeded in an attempt to achieve the target trim position; and a difference between the target trim position and the actual trim position is outside of a given deadband.

U.S. patent application Ser. No. 17/068,332 discloses a method for aligning steering angles of marine propulsion devices. The method includes receiving a first steering request to steer the marine propulsion devices, where when the first steering request is received, steering for a first device is deactivated and steering for a second device is activated, and changing a steering angle of the second device according to the first steering request while leaving a steering angle of the first device unchanged. The method includes receiving a request to activate steering for the first device and receiving a second steering request, then changing the steering angles of both the first and second devices when the second steering request is received after receiving the request to activate steering, and changing the steering angle of the second device while leaving the steering angle for the first device unchanged when the second steering request is received before receiving the request to activate steering.

U.S. patent application Ser. No. 17/146,786 discloses a method of operating a steering system on a marine vessel that includes changing a maximum drive angle defining a permitted drive angle range for at least one marine drive and then, based on a steering map correlating wheel positions of a manually rotatable steering wheel to drive angles of the marine drive, adjusting at least one end stop wheel position to an adjusted end stop wheel position based on the changed maximum drive angle. Once it is determined that a current wheel position of the steering wheel is approaching the adjusted end stop wheel position, a resistance device is controlled to apply a resistance force against rotation of the steering wheel in a first rotational direction past the end stop position. The steering actuator associated with the marine drive is then controlled based on the steering map such that a drive angle of the marine drive stays within the permitted drive angle range.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment includes a method of controlling a marine drive on a marine vessel includes receiving a trim position instruction to adjust a trim position of the marine drive and determining an allowable steering angle range based on the trim position instruction or the adjusted trim position of the marine drive. A trim actuator is controlled to adjust the trim position of the marine drive based on the trim position instruction and a steering actuator is controlled to automatically adjust steering position of the marine drive such that it remains within the allowable steering range.

In another embodiment, a system for controlling the position of the marine drive on a marine vessel includes a user input device operable by a user to input a trim position instruction to adjust a trim position of the marine drive, a trim actuator configured to adjust the trim position of the marine drive in response to the trim position instruction, a steering actuator configured to adjust a steering position of the marine drive, and a controller. The controller is configured to receive the trim position instruction generated at the user input device and to determine an allowable steering angle range based on the trim position instruction. The controller is further configured to control a trim actuator to adjust the trim position of the marine drive based on the trim position instruction and to automatically control a steering actuator to adjust a steering position of the marine drive to remain within the allowable steering angle range.

In yet another embodiment, a system for controlling position of a marine drive on a marine vessel includes a user input device operable by user to input a trim position instruction to adjust a trim position of the marine drive, a trim actuator configured to adjust the trim position of the marine drive in response to the trim position instruction, a steering actuator configured to adjust the steering position of the marine drive, and a controller configured to control the trim position and the steering position simultaneously so as to force the marine drive toward a centered steering position as the trim position increases toward a maximum trim position.

In another embodiment, a method of controlling at least one marine drive on a marine vessel includes determining that a trim position sensor has failed for a first marine drive, determining an allowable steering angle range for the first marine drive based on a first assumed trim position, and determining a steering position adjustment based on the allowable steering angle range. A steering actuator is controlled to automatically adjust the steering position of the marine drive based on the steering position adjustment. A trim position adjustment is determined based on a second assumed trim position for the marine drive and a trim actuator is controlled to adjust the trim position of the first marine drive based on the trim position adjustment.

In one example of the method, the first and second assumed trim positions are the same value, such as both equivalent to a last known trim position of the marine drive.

In another example of the method, the first and second assumed trim positions are differing values. For instance, the first assumed trim position is predetermined trim position where a propeller on the marine drive is at or near the water surface and the second assumed trim position is a minimum trim position.

An embodiment of the system for controlling position of a marine drive on a marine vessel includes a trim actuator configured to adjust a trim position of the marine drive, a trim position sensor configured to sense the trim position of the marine drive, a steering actuator configured to adjust a steering position of the marine drive, and a control system. The control system is configured to determine that the trim position sensor has failed, determine an allowable steering angle range for the marine drive based on a first assumed trim position, and control the steering actuator to automatically adjust the steering position of the marine drive to remain within the allowable steering angle range. The control system is further configured to determine a trim position adjustment based on a second assumed trim position for the marine drive, wherein the control the trim actuator is controlled to adjust the trim position of the marine drive based on the trim position adjustment.

In one example, the first and second assumed trim positions are the same value, such as both equivalent to a last known trim position of the marine drive.

In another example, the first and second assumed trim positions are differing values. For instance, the first assumed trim position is predetermined trim position where a propeller on the marine drive is at or near the water surface and the second assumed trim position is a minimum trim position.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
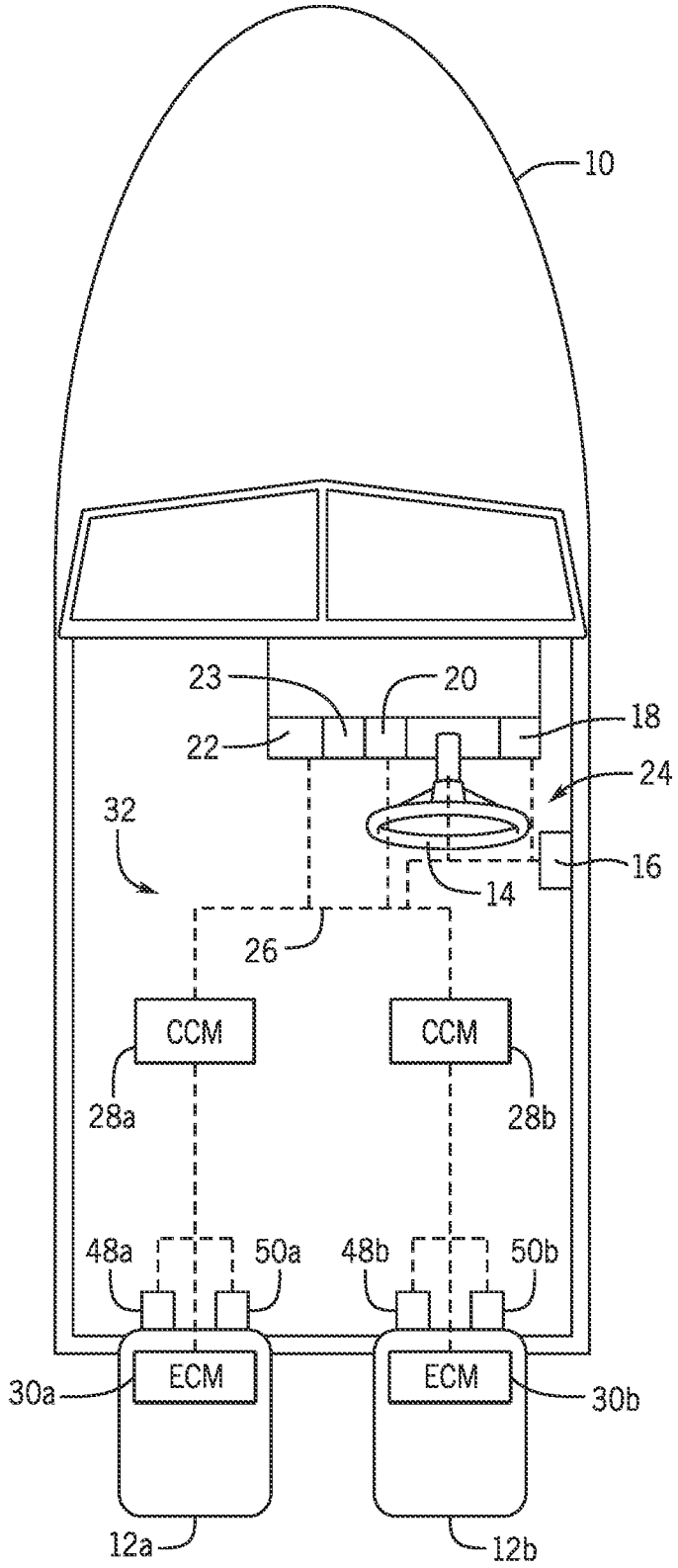
FIG. 1 is a schematic depiction of a marine vessel having a plurality of marine drives and user input devices.

The inventors have recognized that a problem exists with drive collision where, in marine vessels with multiple independently steerable drives (e.g., multiple outboard drives configured for joystick steering), the drives can collide with one another at certain steering and trim positions. The chance for drive collision becomes greater when the drives are mounted close together, such as where several drives are mounted to the transom or where two or more drives are mounted close together at the center of the vessel's stern. Drive collision can damage the propeller, gear case, or other portions of either or both of the colliding drives, and can even leave one or more of the colliding drives inoperable. Thus, avoidance of drive collision is extremely important.

On many current multi-engine vessels, drive collision is avoided by utilizing a mechanical tie bar (such as a collapsible tie bar) or other mechanical link between the drives that prevents the drives from being steered into positions where they might collide with peer drives. These tie bar solutions connect adjacent drives together in such a way so as to physically prevent adjacent drives from moving into positions where they can collide with one another. However, tie bar solutions and other solutions that mechanically link two drives are not workable for drive configurations where the steerable portion of the drive is below the water surface, such as stern drives and or outboard drives with steerable gear cases. In these types of drives, a tie bar or other mechanical link between the steerable drive portions would have to be mounted below the water surface, which would create drag and other unwanted affects and would not be a workable solution. Thus, a solution is needed for preventing drive collision that does not require mechanically linking the marine drives.

Moreover, through their experimentation, research, and experience in the relevant field, the inventors have recognized that drive collision is most likely to happen during trim transition, where the trim angle of one or more of the drives is being adjusted. The risk of drive collision is particularly high during large trim adjustments where one drive is being fully trimmed up to pull it out of the water or is being trimmed down from a fully trimmed up position to put the drive into the water. During these trim transitions, a situation can occur where the steerable portion of the trimmed drive (e.g., that that includes the propeller) impacts a portion of the adjacent drive, such as the cowl, gearcase, cavitation plate, etc. Alternatively, a situation can occur where the gearcase or other portion of the trimmed drive can be lowered onto and impact the propeller or steerable portion of the adjacent drive. These types of impacts can cause severe damage to one or both colliding drives.

In view of the forgoing problems and challenges with drive collision avoidance recognized by the inventors, the disclosed system and method were developed to provide a software solution for avoiding drive collision. In the disclosed system and method, the allowable steering angle range of one or more of the marine drives is limited based on trim position. For example, an allowable steering angle range is defined for various trim positions. The drive steering angle is then automatically controlled to remain within the allowable steering angle range as the drive is trimmed up or trimmed down in response to an instruction to change the trim position of the drive.

In one embodiment, trim position and steering position are adjusted simultaneously so as to force the steerable drive toward a centered steering position as the trim position increases toward a maximum trim position. In certain embodiments, a threshold trim position is set below which a maximum steering angle range is permitted, and thus no limitations are set beyond the normal steering angle limitations set for a multi-drive system. Once the trim position is adjusted above the threshold trim position, the allowable steering angle range narrows around the centered steering position so as to force the marine drive toward the centered position, particularly once the drive has reached a threshold trim position where the propeller is substantially or totally above the water surface. Thereby, the drives are prevented from moving into positions where they can collide with peers because no collision will occur when the drives are in or near the centered steering position.

FIG. 1 schematically depicts a marine vessel 10 having a plurality of marine drives 12*a*, 12*b*. In the example, the marine drives 12*a*, 12*b* are port and starboard marine drives respectively, and are shown coupled to the stern of the marine vessel 10. In other embodiments, the marine vessel 10 may be configured with more than two drives, such as multi-drive systems with three, four, five, or six drives. The marine drives 12*a*, 12*b* shown herein are outboard motors, but could alternatively be stern drives. The marine vessel 10 further comprises at least one user input device. In the example shown, the at least one user input device comprises a steering wheel 14, throttle lever 16, joystick 18, keypad 20, touchscreen 22, and/or trim control buttons 23. The trim control buttons 23 may be a keypad, lever, or any other arrangement configured to facilitate user input to control trim position of the marine drives 12. In other embodiments, the keypad 20 and/or touchscreen 22 may be configured as user input devices for inputting a trim position instruction to control and adjust trim position of one or more of the marine drives 12. Each of these user input devices is located at a helm 24 of the marine vessel 10.

Each of the user input devices 14, 16, 18, 20, 22 is communicatively connected via a controller area network (CAN) bus 26 to one or more controllers, such as command control modules (CCMs) 28*a*, 28*b*. The CCMs 28*a*, 28*b* effectively receive and send all signals from and to the user input devices at the helm 24. In the depicted examples, the CCMs 28*a*, 28*b* are communicatively connected via the CAN bus 26 to engine control modules (ECMs) 30*a*, 30*b* on each marine drive 12. This control system 32 arrangement is merely representative and various other arrangements are known and within the scope of the disclosure. For example, each drive may comprise two or more controllers, such as a powertrain control module (PCM) and a thrust vector module (TVM), as is well-known in the art. In other alternative control system 32 arrangements, a central control module may be provided in addition to or in place of the CCMs 28*a*, 28*b*.

The system 9 for positioning a marine drives 12*a* and 12*b* further includes a trim actuator 48*a* and 48*b* and a steering actuator 50*a* and 50*b* associated with each drive 12*a* and 12*b*. In the depicted example, each CCM 28*a* and 28*b* is communicatively connected (e.g., via a CAN bus arrangement) and configured to control the trim actuators 48 and steering actuators 50; however, various other control arrangements are possible and well known in the relevant art. The trim actuators 48*a*, 48*b* move the marine drives 12*a*, 12*b* to a requested trim position, in response to signals sent from the CCMs 28*a*, 28*b*, such as based on input from the user input devices (e.g., trim control buttons 23). Further, the control system 32 comprises trim angle sensors 35*a*, 35*b* for sensing current trim positions of the marine drives 12*a*, 12*b* and providing this data to the control modules via the CAN bus 26. The steering actuators 50*a*, 50*b* steer the marine drives 12*a*, 12*b* in response to signals sent from the CCMs 28*a*, 28*b* via the CAN bus 26. Control of the steering actuators 50*a* and 50*b* may further be based on steering position sensed by the steering position sensors 55*a* and 55*b* configured to sense and actual steering position of the steerable drive portion.

Now referring to FIGS. 2-5, various trim positions of the marine drives 12*a*, 12*b* will be described. In the example shown in FIGS. 2-5, only the starboard marine drive 12*b* is shown. However, it should be understood that the port marine drive 12*a* is or may be positioned in the same trim positions as the starboard marine drive 12*b* shown in these figures, and can therefore not be seen behind the starboard marine drive 12*b*. It should be understood that in alternative embodiments, the marine vessel 10 may be propelled by more than two marine drives. It should also be understood that in other examples, the two marine drives 12*a*, 12*b* may have different trim positions from one another.

Figure 2:
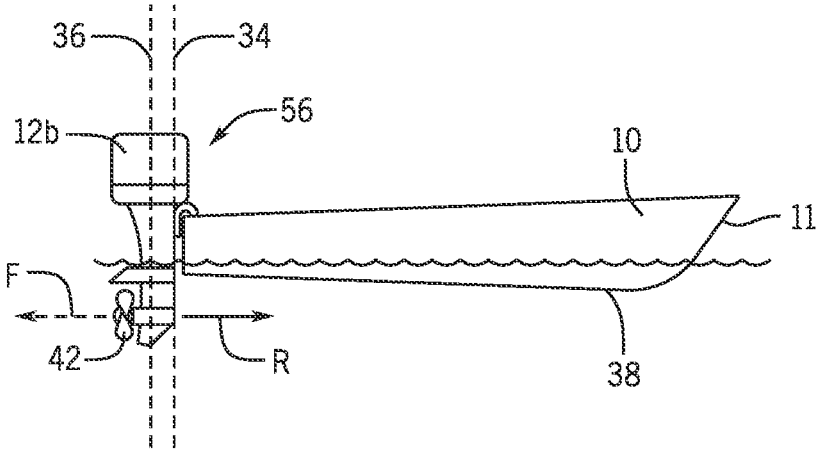
FIG. 2 is a side view of a marine vessel having a marine drive in a neutral trim position.
Figure 3:
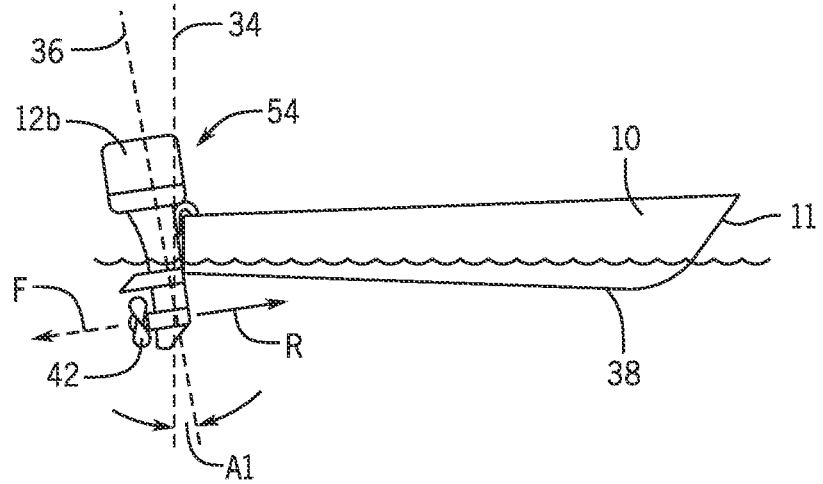
FIG. 3 is a side view of a marine vessel having a marine drive in a trimmed down position.

In each of FIGS. 2-5 the trim position of the marine drive 12*b* is shown with respect to a dashed line representing a vertical axis 34. Additionally, another dashed line in each of the figures represents a longitudinal axis 36 through the marine drive 12*b*. The angle between the vertical axis 34 and the longitudinal axis 36 is the trim angle A. In FIG. 2, the marine drive 12*b* is in a neutral trim position in which the vertical axis 34 and the longitudinal axis 36 are generally parallel to one another. In FIG. 3, the marine drive 12*b* is trimmed all the way down (trimmed in) such that a propeller 42 of the marine drive 12*b* is closer to a hull 38 of the marine vessel 10 than when the marine drive 12*b* is in the neutral trim position. This position is sometimes referred to as "full tuck." In FIG. 4 the marine drive 12*b* is trimmed up (trimmed out) such that the propeller 42 is further from the hull 38.

Figure 4:
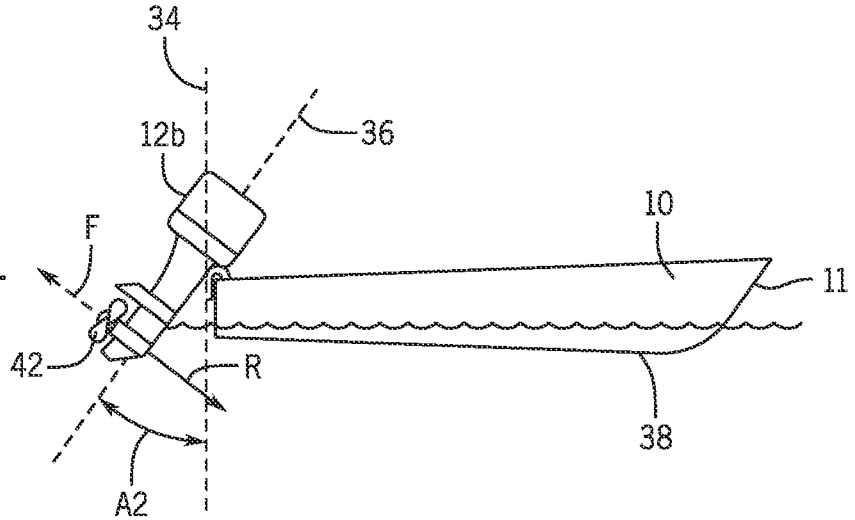
FIG. 4 is a side view of a marine vessel having a marine drive in a trimmed up position.
Figure 5:
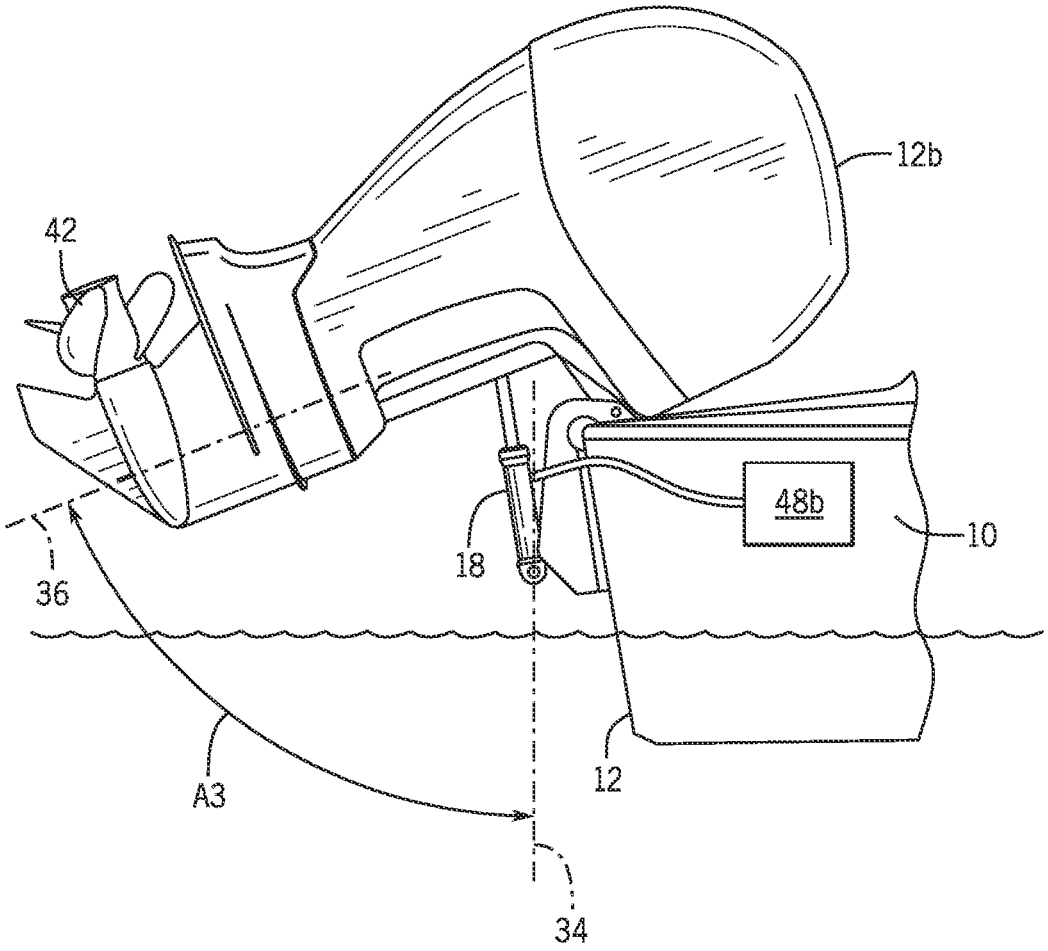
FIG. 5 is a side view of a marine vessel having a marine drive in a maximum trim position where the drive is fully trimmed up.

In FIG. 4 the propeller 42 of the drive 12*b* is at or near the water surface. For trim positions at and/or above that point, thrust will not be fully effectuated because the propeller 42 will not be fully engaged with the water. Thus, the drive 12*b* will to be able to fully effectuate steering or thrust commands in that position and trim positions at or above that point are generally undesirable when the drive 12*b* is engaged propulsion operations for the vessel. FIG. 5 is a closer depiction of the drive 12*b* trimmed up even further, which may represent the drive 12*b* in a maximum trim position where it is fully trimmed up (or trimmed out) and is lifted out of the water. Marine drives are placed in this position when they are inoperative, such as when they are not needed for low speed steering operations or when a malfunction has occurred with that drive. In this position the drive 12*b* is lifted out of the water so that it does not create drag and/or so that it is out of the way.

FIG. 2 depicts the marine drive 12*b* in a neutral trim position. In the example shown in FIG. 2, the trim angle of the marine drive 12*b* is such that a reverse thrust R provided by the marine drive 12*b* does not intersect with the hull 38 of the marine vessel 10 during any rotational orientation of the marine drive 12*b* about its longitudinal axis 36. Further, the trim angle of the marine drive 12*b* is such that reverse thrust R is not trimmed too far up away from the vertical axis 34 such that the marine drive 12*b* may still efficiently achieve reverse or rotational movement of the marine vessel 10. In the example of FIG. 2, the trim position (shown by longitudinal axis 36) is substantially parallel to the vertical axis 34.

The marine drive 12*b* can be acutely or obtusely angled with respect to the vertical axis 34. FIG. 3 shows the marine drive 12*b* in a trimmed down (trimmed in) position. In the fully trimmed in position, the marine drive 12*b* is angled such that the propeller 42 is closer to the hull 38 of the marine vessel 10 than when in the neutral position, and its longitudinal axis 36 is oriented at an angle A1 with respect to the vertical axis 34 (which may be described as a negative angle).

In FIG. 4, the marine drive 12*b* is shown in a trimmed up (trimmed out) position in which the propeller 42 is further from the hull 38 of the marine vessel 10 than when in the neutral position, and the longitudinal axis 36 extends at an angle A2 with respect to the vertical axis 34. This provides a reverse thrust R in a somewhat downwardly angled direction as shown and minimal or no forward thrust can be provided because the propeller 42 is at or above the water surface; however, when the vessel 10 is on plane this drive position may be operable to provide forward thrust. In positions beyond that in FIG. 4, such as the maximally trimmed up position at FIG. 5, no thrust can be effectuated. To provide just one example, the angle A2 may be around 20 degrees of trim, which in various embodiments may be greater or less depending on the vessel configuration, drive configuration, etc.

The trimmed down position shown in FIG. 3 is a position that is conventionally used during initial forward acceleration (or launch) of the marine vessel 10 until full forward translation when the marine vessel 10 is on-plane. During such initial forward acceleration, the propeller 42 rotates forwardly to provide forward thrust (shown by dashed line F) to propel the marine vessel 10 forwardly. When the marine drive 12*b* is at this trim position for accelerating into forward translation of the marine vessel 10, the marine drive 12*b* provides forward thrust F that is angled somewhat downwardly.

Once the marine vessel 10 is in full forward translation and on-plane, the marine drive 12*b* is typically trimmed back out of the trim position shown in FIG. 3, past the vertical axis 34, and to a slightly raised (trimmed out) trim position. (e.g., toward the position in FIG. 4). This trimmed up position achieves, for example, optimal speed, riding vessel angle, fuel economy, and/or other desired performance characteristics.

Figure 6:
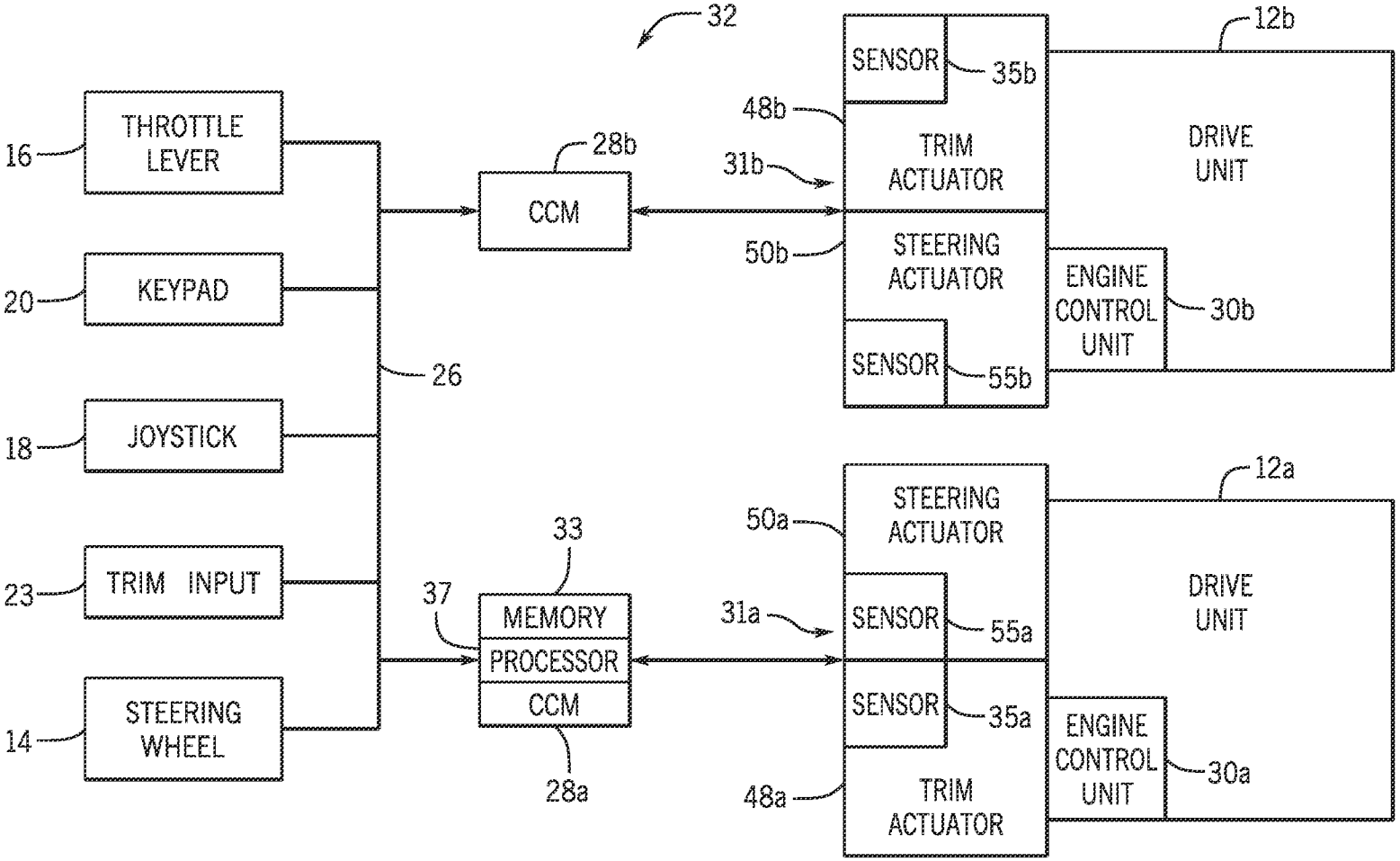
FIG. 6 is a schematic showing an exemplary a control system for controlling a plurality of marine drives according to one embodiment of the present disclosure.

FIG. 6 depicts a schematic representation of a control system 32 that can be used to position the marine drives 12*a*, 12*b* on the marine vessel 10. As described hereinabove, the control system 32 comprises a throttle lever 16, joystick 18, keypad 20, trim input 23 (e.g., trim control buttons), and steering wheel 14 (collectively, the user input devices) connected via a CAN bus 26 to CCMs 28*a*, 28*b*. It should be understood by those having skill in the art that a CAN bus need not be provided, and that these devices could instead be wirelessly connected (or connected by a different communication system) to one another and/or to the CCMs 28*a*, 28*b*. Further, the connections shown in dashed lines in both FIGS. 1 and 6 are for exemplary purposes only, and may be wired other than as shown herein.

Signals from each of the user input devices 14, 16, 18, 20, 23 are sent via the CAN bus 26 to helm controller(s) (in this example CCMs 28*a*, 28*b*), which interpret these signals and send commands to the trim actuators 48*a* and 48*b* and steering actuators 50*a* and 50*b*. In the example shown, the CCMs, PCMs, and TVMs are illustrated as separate modules controlling separate functions aboard the marine vessel 10; however, it should be understood that any of the control sections shown and described herein could be provided in fewer modules or more modules than those shown.

Any of the controllers may have a memory and a programmable processor, such as processor 37 and memory 33 in CCM 28*a*. As is conventional, the processor 37 can be communicatively connected to a computer readable medium that includes volatile or nonvolatile memory upon which computer readable code (software) is stored. The processor 37 can access the computer readable code on the computer readable medium, and upon executing the code can send signals to carry out functions according to the methods described herein below. Execution of the code allows the control system 32 to control a series of actuators (for example steering actuators 50*a*, 50*b* and trim actuators 48*a*, 48*b*) of the marine drives 12*a*, 12*b*. Processor 37 can be implemented within a single device but can also be distributed across multiple processing devices or sub-systems that cooperate in executing program instructions. Examples include general purpose central processing units, application specific processors, and logic devices, as well as any other type of processing device, combinations of processing devices, and/or variations thereof. The control system 32 may also obtain data from sensors aboard the vessel (e.g., trim position sensors 35*a* and 35*b* and steering position sensors 55*a* and 55*b*, and the processor 37 may save or interpret the data as described herein below. In the example shown, at least the port CCM 28*a* comprises a memory 33 (such as, for example, RAM or ROM), although the other control modules could be provided with a memory as well.

Figure 7:
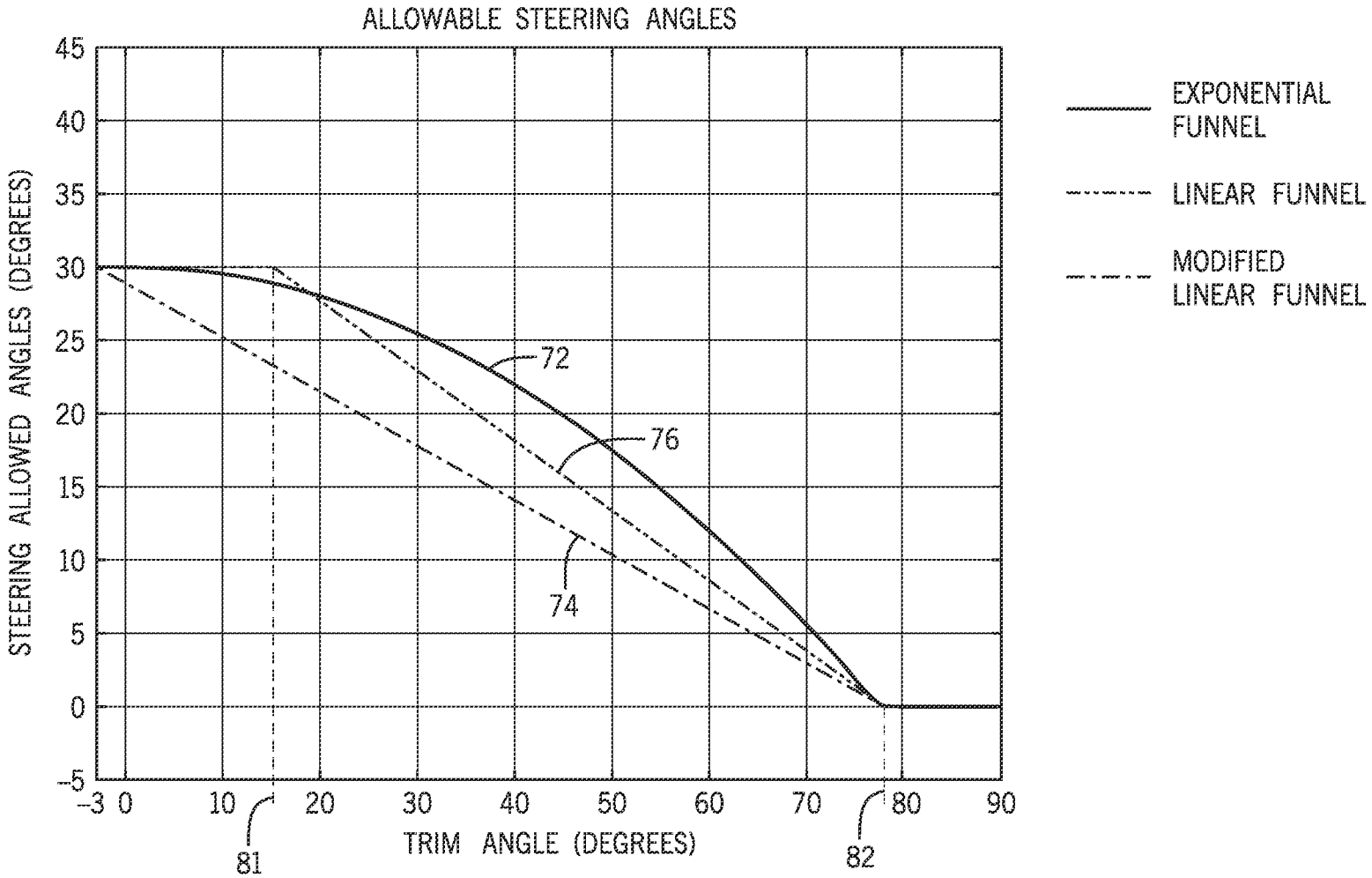
FIGS. 7 and 8 are graphs showing exemplary relationships between trim and steering angle range, exemplifying embodiments of the present disclosure.
Figure 8:
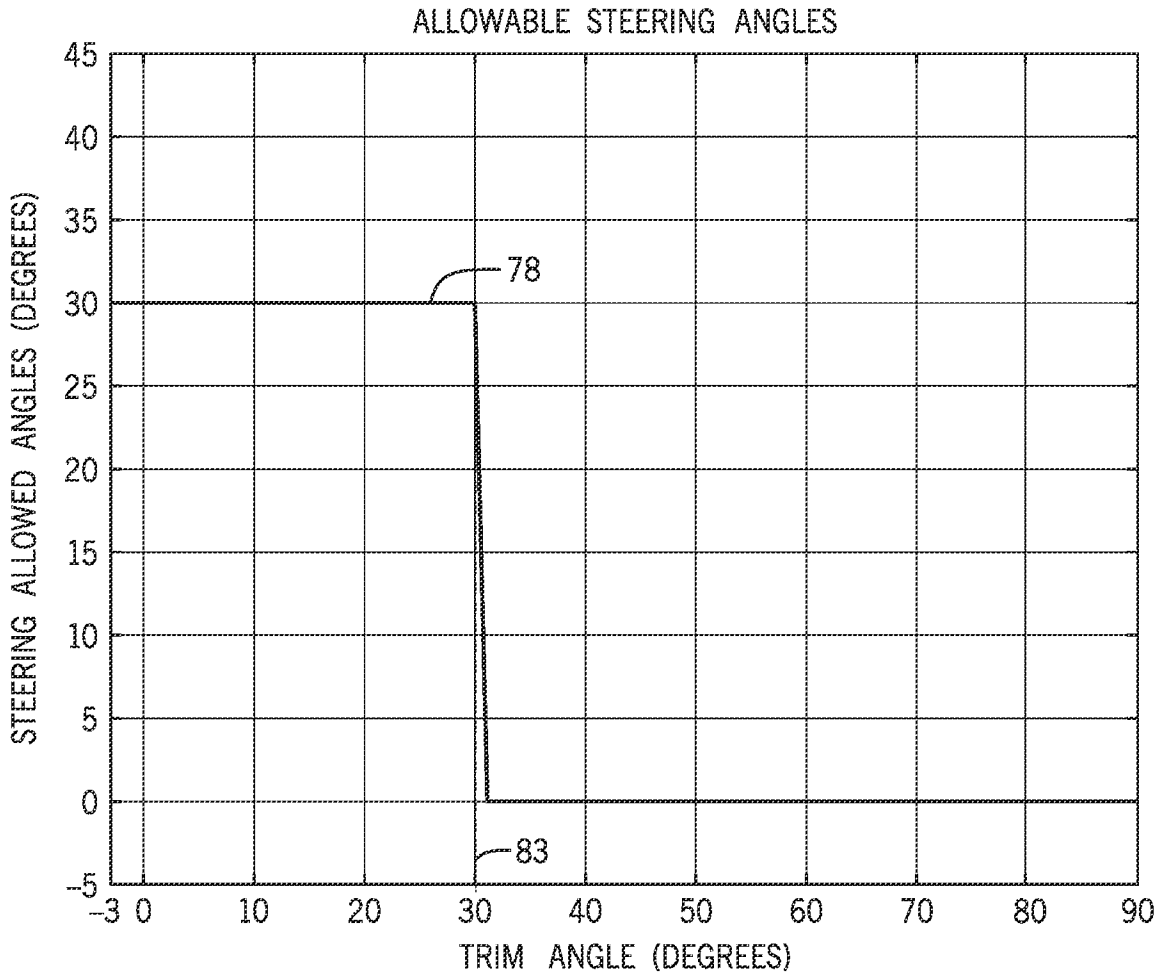

Now referring to FIGS. 7-10, exemplary methods for positioning the marine drive 12*a*, 12*b* on the marine vessel 10 are described and shown. FIGS. 7 and 8 are graphs illustrating various schemes for setting an allowable steering angle range based on trim. The allowable steering angle range represents the permitted steering angles, and thus the angles at which the drive can be positioned in response to a steering instruction. The allowable steering angles may be symmetrical about the centered steering position, or 0 steering angle, which is generally perpendicular to the stern of the vessel 10. The graphs represent allowable steering angle magnitude from the centered steering position, and thus the allowable steering angle range will be the depicted steering angle magnitude on either side of the centered steering position. For instance, the maximum allowed steering angle of 30 degrees represents an allowable steering angle range of +30 degrees and −30 degrees with respect to the centered steering position. When the allowable steering angle range is set to the maximum steering range, the drive can be steered to any position within that range 60 degree total range, such as based on inputs from the steering wheel 14, joystick 18, etc.

The allowable steering angle range is a maximum steering angle range where no additional constraints are placed on the permitted steering angles beyond those normally in place for steering the drives on the marine vessel. As will be known to a person of ordinary skill in the art, the maximum steering angle range is normally constrained in drive-by-wire applications, for example, based on the range of the steering actuator 50, the mount for the steerable portion of the marine drive 12, the location and arrangement of the marine drives, etc. At the maximum steering angle range, no trim-based constraints are enacted. But as the trim angle increases toward the maximum trim angle, the allowable steering angle range narrows around the centered steering position so as to force the marine drive toward the centered steering position as the marine drive is trimmed up toward the maximum trim position. This may be a gradual centering as the drive is trimmed up. In other embodiments, the drive may be automatically and fully centered when it is raised above a threshold trim position.

Various algorithms and relationships for controlling steering position based on trim may be implemented, examples of which are shown in FIGS. 7 and 8. FIG. 7 depicts three different exemplary relationship between trim angle and allowable steering angle range. In these examples, the allowed steering angle range progressively narrows around the centered steering position, between a maximum steering angle range at a minimum trim position and a zero steering angle (representing a centered steering position) at a maximum trim position where the marine drive is fully trimmed up and out of the water. In these examples, the minimum steering angle is a steering angle of −3 degrees and the maximum steering angle is 90 degrees. As will be known to a person having ordinary skill in the art, the values and range between minimum and maximum steering angles may vary depending on the vessel and drive configurations.

Line 72 represents an exponential relationship between allowed steering angle and trim angle where the allowable steering angle range decreases exponentially as the trim angle increases. In the depicted exponential relationship, the allowable steering angle range is at a maximum at low trim angle ranges close to 0, and begins to narrow at about 5 degrees of trim. In other embodiments, the allowable steering angle range may remain at the maximum steering angle range for trim positions below a threshold trim position, such as below the first trim position threshold 81 illustrated with respect to the modified linear funnel illustrated a lines 76 and discussed below. The exponential relationship is configured to progressively move the steerable drive to the centered steering position as the trim angle of the drive increases such that the centered steering position is reached at or before the drive reaches the maximum trim position. In the depicted embodiment, the steering angle constraints are configured such that the drive is forced to the centered position as the trim angle reaches a second threshold trim position 82, which is less than the maximum trim position.

The two other lines at FIG. 7 depict exemplary linear relationships between allowed steering angle range and trim angle. Line 74 represents a linear funnel where the allowed steering angle range decreases linearly as the trim angle increases between the minimum trim position where the drive is fully tucked and the second threshold where the drive is at or near the maximum trim position. Line 76 represents a second exemplary linear relationship where the steering angle range decreases linearly between a first threshold trim position 81 and the second threshold trim position 82. Thus, the allowable steering angle range is the maximum steering angle range of 30 degrees at all trim positions below the threshold trim position 81, which in the depicted example is about 15 degrees of trim. The allowable steering angle range then progressively narrows as the trim angle increase so as to force the drive into the centered position.

FIG. 8 represents another embodiment where the relationship between trim and steering angle is a step function. An exemplary step profile is presented by line 78, where a maximum allowable steering angle range is associated with trim positions below the threshold trim position 83 and for trim positions above the threshold trim position 83, the allowable steering angle range is the centered steering position. Thus, the steerable drive 12 is centered once during the trim up process when the trim angle passes the threshold 83. This arrangement has the benefit of only needing to activate the steering actuator 50 once during a trim up routine where the drive is being raised out of the water. In certain embodiments, hysteresis may be implemented to avoid toggling the steering position of the drive if trim is adjusted slightly up or down around the established threshold trim value.

In the example depicted at FIG. 8, the threshold trim position 83 is 30 degrees; however, in various embodiments the threshold trim position can be less than or greater than 30 degrees. Preferably, at the threshold trim position 83 the propeller 42 is at or above the water surface, and thus the drive is not actively steering the marine vessel. Thus, a forced change in steering position will not affect the propulsion vector acted on the marine vessel 10. For example, the threshold trim position 83 may be greater than or equal to the trimmed out position depicted a FIG. 4 where the propeller 42 is at the water surface. In other embodiments, the threshold trim position 83 may be substantially greater than the angle depicted at FIG. 4 such that the propeller is well above the water surface before the centering occurs.

The allowable steering angle range is then determined based on trim positions. For example, the relevant controller may store a lookup table providing allowable steering angle range in association with trim angle. The allowable steering angle range may then be determined by utilizing the lookup table, such as based on a current trim position occupied by the marine drive and sensed by the trim angle sensor 35 or based on a target trim position determined based on the trim position instruction provided at the user input device.

Figure 9:
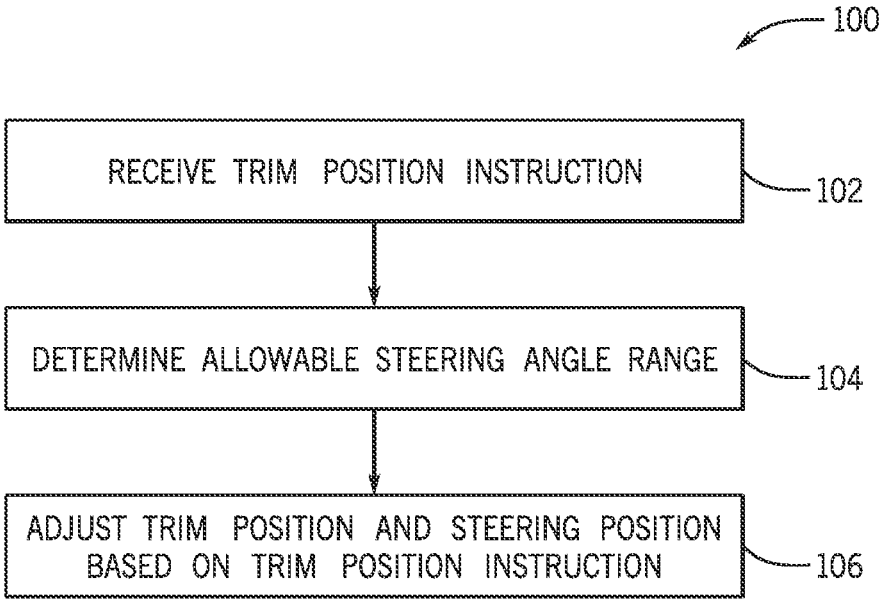
FIGS. 9 and 10 are flow charts illustrating exemplary methods of controlling position of marine propulsion devices.
Figure 10:
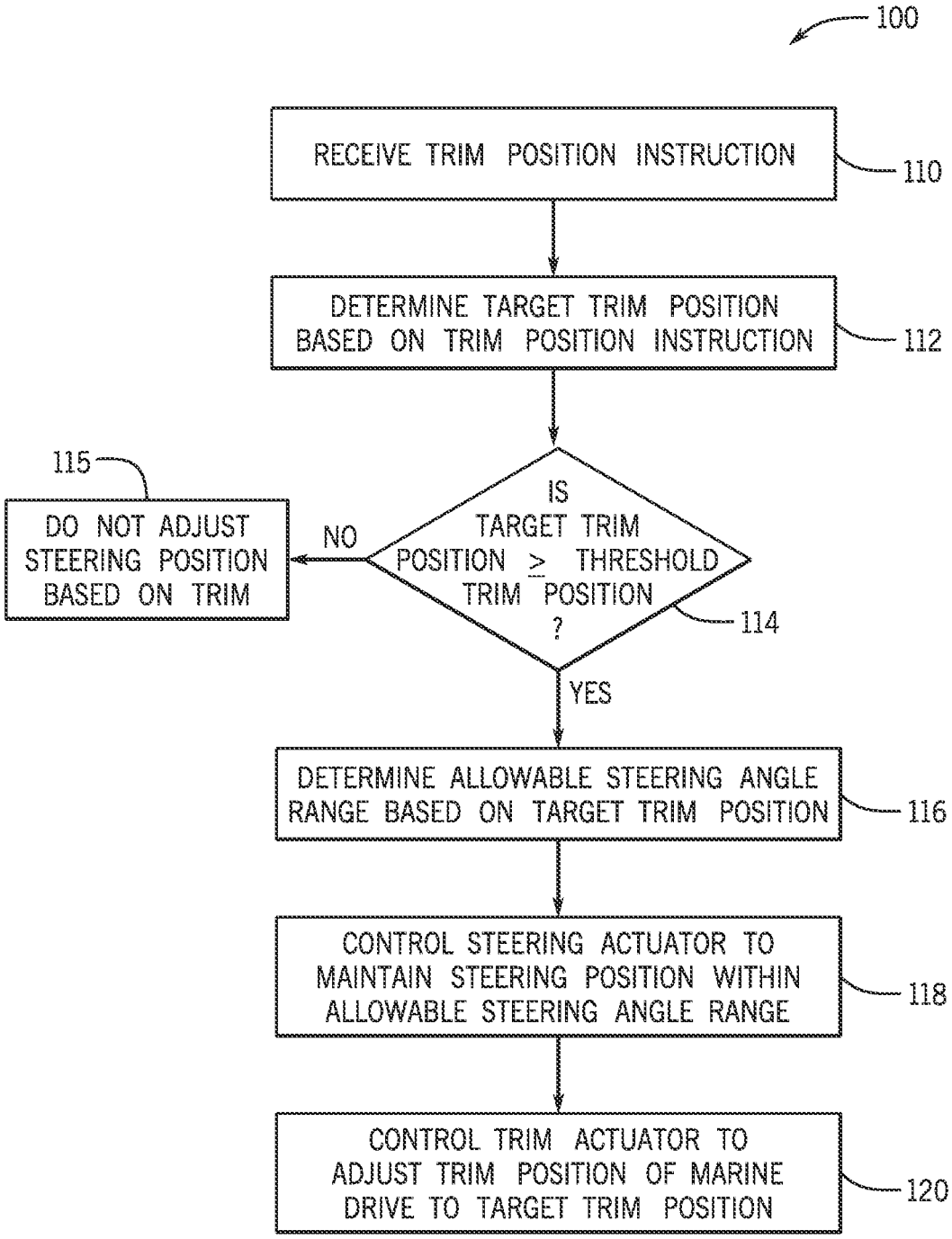

FIGS. 9 and 10 depict exemplary methods of controlling a marine drive on a marine vessel in order to avoid drive collision during trim position changes, as described herein. In the flowchart at FIG. 9, the method 100 includes receiving a trim position instruction at step 102, such as from a user input device configured to receive user input to adjust a trim position of the marine drive (e.g., trim control input buttons 23, or any other user input device configured for inputting trim control commands). An allowable steering range is then determined at step 104 that accounts for the adjusted trim position based on the trim position instructions. The trim position and steering position are then adjusted accordingly at step 106 such that the steering angle of the steerable marine drive remains within the allowable steering angle range. In various embodiments, the allowable steering angle range may be determined based on a trim position occupied by the drive, such as after effectuating the trim position adjustment commanded by the trim position instruction. In other embodiments, the allowable steering angle range may be determined based on the target trim position commanded by the trim position instruction. An example of such an embodiment is depicted at FIG. 10.

In the flowchart at FIG. 10, the method 100 of controlling a marine drive includes receiving a trim position instruction at step 110 and then determining a target trim position at step 112 based on the trim position instruction. Target trim position determinations based on user inputs at trim control input devices are well known in the relevant art, examples of which are shown and described in U.S. Pat. No. 9,751,605, which is incorporated herein. Logic is executed at step 114 to determine whether the target trim position is greater than a threshold trim position. The target trim position here is a threshold, wherein at trim positions below the threshold steering range is not narrowed based on trim. Thus, if the target trim position is less than the threshold trim position, then no steering adjustment is made as represented at step 115.

In embodiments where the relationship between trim and steering position is a step function, such as exemplified in FIG. 8, the threshold trim position utilized at step 114 may be the threshold trim position 83 representing a position where the propeller 42 of the marine drive is at or above the water surface. However, in various embodiments the threshold trim position utilized at step 114 may be at a lower trim position, such as the threshold trim position 81 represented at FIG. 7.

Once the target trim position exceeds the threshold trim position, the allowable steering angle range is narrowed at step 116 based on the target trim position. For example, the allowable steering angle range may be determined using a lookup table based on the target trim position. In embodiments where the allowable steering angle range is a step function such as that depicted in FIG. 8, the allowable steering angle range will represent the centered steering position. The steering actuator is then controlled at step 118 to maintain the steering position within the allowable steering angle range. The trim actuator is controlled to adjust the position of the marine drive to the target trim position at step 120.

In view of their extensive experimentation and research in the relevant field, the inventors have recognized that further improvement of systems and methods for avoiding drive collision is necessary to account for failure conditions where a marine drive is not running (such as due to drive failure or selective non-operation) and the trim position sensor 35*a*, 35*b* has failed or is otherwise not communicating an accurate trim position within the control arrangement. Where the trim position of one of the plurality of marine drives is not known, it may be desirable to trim that drive with the failed trim sensor out of the water and out of the way of the other drives so that collision with that that marine drive is not a concern.

As described above, when one of the plurality of marine drives 12*a*, 12*b* is not operating, a steering limit is imposed on adjacent marine drive, limiting a maximum steering angle beyond the limits imposed in normal operation to avoid drive collision. Such steering limits may be imposed based on trim position of each of the adjacent drives to the non-operating drive. To remove the steering limits, the non-operating drive may be trimmed up using the methods and systems described above so that it is out of the way of the adjacent drives. However, a solution is needed where the non-operating drive can be trimmed up even when the trim sensors has failed.

The inventors have further developed the disclosed system and method wherein, upon detection of a trim sensor failure, the marine drive is trimmed up based on the above-described steering and trim relationships and limits using one or more assumed trim positions based on the information available to the system and/or worst-case-scenario assumptions, where necessary, to enable trimming the marine drive with the non-functioning trim sensor while avoiding collision with neighboring drives. For example, upon determining that the trim position sensor 35*a*, 35*b* associated with and measuring the trim position of one of the marine drives 12*a*, 12*b* has failed, the control system 32 controls steering and/or trim based on one or more assumed trim positions. Depending on the information available to the control system 32, the same or different assumed trim positions may be utilized for controlling steering versus for controlling trim.

Figure 11:
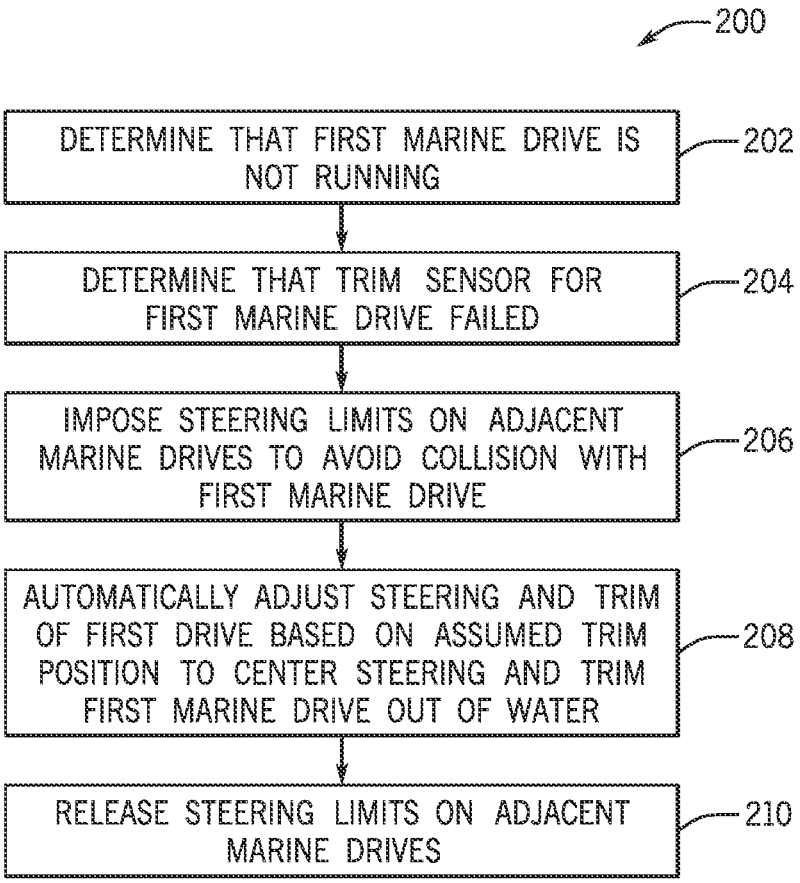
FIGS. 11 and 12 are flow charts illustrating additional exemplary methods of controlling marine propulsion devices in accordance with the present disclosure.
Figure 12:
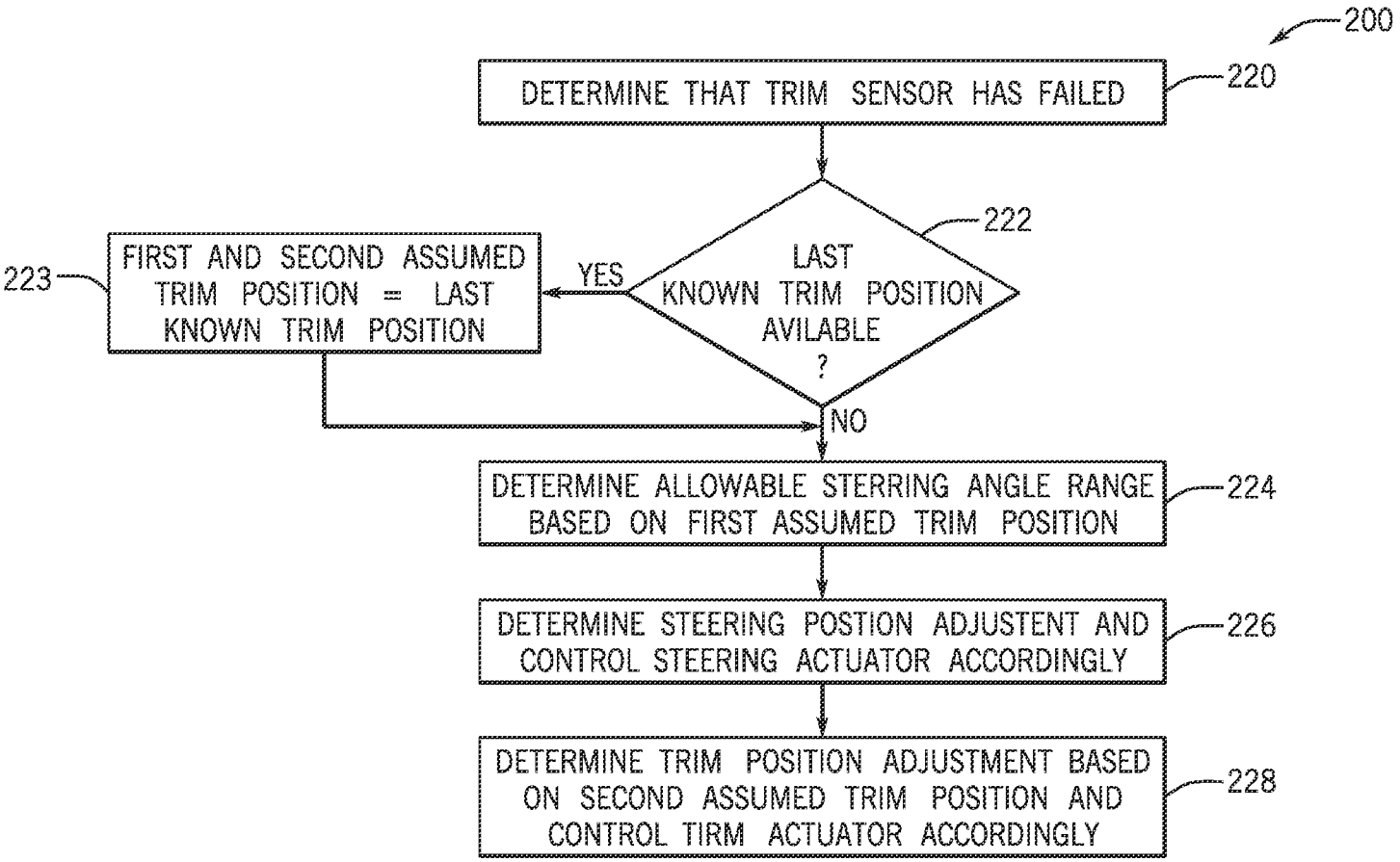

FIGS. 11 and 12 depict exemplary embodiments of methods 200 for controlling at least one marine drive where a trim position sensor has failed. In FIG. 11, it is determined that a marine drive 12*a*, 12*b* is not running, which could be a result of an engine failure or other drive failure or due to elective non-operation of the drive by a user. Failure of the corresponding trim position sensor 35*a*, 35*b* is also detected at step 204. Steering limits are then imposed on adjacent marine drives at step 206 to limit the maximum steering position permitted and avoid collision with the non-operating marine drive. In this situation, the non-operating marine drive needs to be trimmed up out of the water to move it out of the way of the adjacent marine drives so that the steering limits can be released.

Steps are executed, represented at block 208, to automatically coordinate and/or effectuate steering and trim control of the non-operating marine drive to center the steering as the marine drive is trimmed up out of the water. In certain embodiments, the control system 32 may require operator input to initiate and/or maintain the trim process, such as via the trim control buttons 23.

Once the control system 32 has determined that the non-operating marine drive is fully trimmed up, such as based on trim position assumptions as described herein, then the steering limits on the adjacent marine drives are released at step 210 and normal steering operation can resume.

FIG. 12 exemplifies steps for controlling the trim and steering based on one or more assumed trim positions, which could be implemented at block 208 of the method 200 shown in FIG. 11. Once the trim position sensor failure is identified at step 220, step 222 is executed to determine whether a last known trim position is available. Where a last known trim position is available—such as a last sensed trim position by the trim position sensor and/or a calculated trim position based on operation of the relevant trim actuator—the assumed trim position(s) can be set based thereon.

Thus, where an accurate last known trim position is available, the first and second assumed trim positions may both be set based thereon, indicated at step 223. This will provide reasonably accurate trim assumptions to allow safe steering funneling and trim control in accordance with the strategies described above. For example, where no trim change has been effectuated since the trim position sensor failure, the assumed trim position may be identified as the last sensed trim position by the trim position sensor 35*a*, 35*b*. Thereafter, the last known trim position can be tracked and updated based on operation time and direction of the trim actuator, where an approximate speed (or trim rate of change) of adjustment for the trim arrangement is known and stored in the control system 32 and the time and direction of activation of the trim actuator 48*a*, 48*b* is tracked. Based thereon, the control system 32 can track and estimate the trim position of the drive despite failure of the trim position sensor 35*a*, 35*b*. That trim estimation may then be used as the assumed trim position for controlling both trim and steering for the non-operating marine drive to trim it up safely.

However, in situations where a last known trim position is not available, such as a trim position sensor failure detected upon key-up of the marine drive(s) 12*a*, 12*b* where no trim information from the last operation cycle is stored, other assumptions may be made about the trim position of the marine drive to enable it to be safely trimmed up out of the water without collision with an adjacent drive. In an exemplary embodiment where last known trim information is not available, differing assumptions about current trim position may be used for controlling steering and for controlling trim.

At step 224, an allowable steering angle range for controlling steering of the marine drive 12*a*, 12*b* with the failed trim position sensor 35*a*, 35*b* is determined based on a first assumed trim position. The allowable steering angle range is thus determined by one of the above-described arrangements for associating steering range to trim. A steering position adjustment is then determined, as indicated at 226, such as based on the current steering position sensed by the steering position sensor 55*a*, 55*b* of the marine drive 12*a*, 12*b* to place the steerable portion of the drive within that allowable range. The steering actuator 50*a*, 50*b* is then controlled to effectuate the steering position adjustment.

The first assumed trim position for controlling steering may be set at a reasonable worst-case trim position that enables determination of necessary steering constraints to ensure that the drive can be trimmed up safely. Thus, the first assumed trim position for controlling steering is configured so that the steerable portion of the marine drive is not permitted to be in a steering position that could cause collision when the drive is trimmed up. The allowable steering angle range narrows as the marine drive is trimmed up, and thus the trim position assumption used for steering may be that the marine drive is in the highest trim position where it could still operate to perform propulsion. In one embodiment, first assumed trim position may be a predetermined trim position where the propeller 43 of the marine drive 12*a*, 12*b* is at or near the water surface, such as that illustrated in FIG. 4.

Depending on the funneling strategy employed, the allowable steering angle range may be a narrow range that would allow the drive to navigate a trim change past adjacent marine drives at the current maximum permitted steering position, no matter the trim position of either adjacent drive. As another example, the allowable steering angle range may represent the centered steering position and/or a small threshold range of positions around the centered position.

The allowable steering angle range is then assigned based on that assumed trim position and the steering actuator is controlled to adjust the steering position of the marine drive as necessary to stay within the required range. The marine drive is thereby steered toward center before and/or as it is trimmed up. In some embodiments, the marine drive 12*a*, 12*b* may be steered to the centered position prior to initiating trim adjustment.

A trim position adjustment is determined at step 228 based on a second assumed trim position. The second assumed trim position for controlling trim may be set differently than that used for steering to account for worst-case conditions related to trim control. For example, the second assumed trim position may be determined to ensure that the marine drive is fully trimmed up, or at least trimmed to a predetermined high trim position where the drive is out of the water and does not pose a collision risk to the adjacent drives. For example, determining the trim position adjustment may include determining a run time for the trim actuator based on the second assumed trim position. The run time is the time that the trim actuator must run to guarantee that the marine drive is moved to the predetermined high trim position, which in one example is a maximum trim position. In such an embodiment, the second assumed trim position is a low trim position, such as a minimum trim position or otherwise where the propeller is well below the water surface. The run time is determined as the time it takes for the trim actuator to trim the marine drive from the second assumed trim position up to the predetermined high trim position, such as based on the known trim rate of change effectuated by the trim actuator 48*a*, 48*b*. In certain configurations, the run time trim position adjustment may be a stored value, such as after the first determination, that may be utilized at the trim position adjustment when and if a last known trim position is not available.

The trim position adjustment for that drive is then effectuated by controlling the trim actuator 48*a*, 48*b*. For example, the control system 32 may require that the trim actuator runs in the upward trim direction for the run time before the marine drive is considered sufficiently trimmed up and the steering limits on adjacent marine drives can be lifted. In one embodiment, the steering actuator may be automatically controlled by the control system 32. In other embodiments, effectuating the trim position adjustment requires user input, which may be user input to initiate the trim-up routine for the drive with the failed trim position sensor. Alternatively, the system may be configured to require that the user continuously command trim-up, such as by trim control button(s) 23, for the entire time that the trim actuator 4*aa*, 48*b* is running. In either embodiment, the control system 32 will not deem the marine drive to be sufficiently trimmed up until the trim actuator has been running, such as at the command of the user, for the run time. In an embodiment where user input is required to initiate or maintain the trim-up process, the user interface may be configured to instruct the user to provide the input necessary to achieve the trim position adjustment.

In some embodiments, after the initial steering position adjustment to bring the marine drive within the allowable steering angle range is effectuated, then the steering and trim may be adjusted simultaneously to progressively center the steering as the trim position increases toward a maximum trim position. In other embodiments, the steering position adjustment may be determined to bring the marine drive to the centered position, and the trim position adjustment may not be initiated until after the steering position adjustment is completed.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A method of controlling at least one marine drive on a marine vessel, the method comprising:

determining that a trim position sensor has failed for a first marine drive;

determining an allowable steering angle range for the first marine drive based on a first assumed trim position;

determining a steering position adjustment based on the allowable steering angle range;

controlling a steering actuator to automatically adjust a steering position of the marine drive based on the steering position adjustment;

determining a trim position adjustment based on a second assumed trim position for the marine drive; and controlling a trim actuator to adjust a trim position of the first marine drive based on the trim position adjustment.

2. The method of claim 1, wherein the trim position adjustment is to trim up the first marine drive to a predetermined high trim position, and further comprising:

determining that the first marine drive is not running; and limiting a maximum steering angle of at least a second marine drive adjacent to the first marine drive upon determining that the first marine drive is not running until the first marine drive reaches the predetermined high trim position.

3. The method of claim 2, wherein the predetermined high trim position is a maximum trim position.

4. The method of claim 1, wherein the first and second assumed trim positions are both equivalent to a last known trim position of the marine drive.

5. The method of claim 4, wherein the last known trim position of the marine drive is determined based on a last sensed trim position by the trim position sensor before failure and/or based on an operation time and operation direction of the trim actuator.

6. The method of claim 1, wherein the first assumed trim position is predetermined trim position where a propeller on the marine drive is at or near a water surface.

7. The method of claim 1, wherein the second assumed trim position is a minimum trim position.

8. The method of claim 1, wherein the allowable steering angle range represents a centered steering position, wherein the steering position adjustment adjusts the steering position to the centered steering position, and wherein the steering position adjustment is completed prior to initiating the trim position adjustment.

9. The method of claim 1, wherein the allowable steering angle range progressively narrows around a centered steering position as the first assumed trim position increases toward a maximum trim position.

10. The method of claim 1, wherein determining the trim position adjustment includes determining a run time for the trim actuator based on the second assumed trim position and the trim actuator is controlled to trim up the marine drive based on the run time.

11. The method of claim 10, wherein the run time is an amount of time it takes for the trim actuator to trim the first marine drive from the second assumed trim position to a predetermined high trim position.

12. The method of claim 11, wherein the second assumed trim position is a minimum trim position and/or the predetermined high trim position is a maximum trim position.

13. The method of claim 1, further comprising completing the steering position adjustment prior to initiating the trim position adjustment.

14. The method of claim 1, wherein the trim position adjustment and the steering position adjustment are executed simultaneously to force the marine drive toward a centered steering position as the trim position increases toward a maximum trim position.

15. A system for controlling position of a marine drive on a marine vessel, the system comprising:

a trim actuator configured to adjust a trim position of the marine drive;

a trim position sensor configured to sense the trim position of the marine drive;

a steering actuator configured to adjust a steering position of the marine drive;

a control system configured to:

determine that the trim position sensor has failed;

determine an allowable steering angle range for the marine drive based on a first assumed trim position;

control the steering actuator to automatically adjust the steering position of the marine drive to remain within the allowable steering angle range;

determine a trim position adjustment based on a second assumed trim position for the marine drive; and control the trim actuator to adjust the trim position of the marine drive based on the trim position adjustment.

16. The system of claim 15, wherein the first and second assumed trim positions are both equivalent to a last known trim position of the marine drive.

17. The system of claim 16, wherein the last known trim position of the marine drive is determined based on a last sensed trim position by the trim position sensor before failure and/or based on an operation time and direction of the trim actuator.

18. The system of claim 15, wherein the first assumed trim position is predetermined trim position where a propeller on the marine drive is at or near a water surface.

19. The system of claim 15, wherein the second assumed trim position is a minimum trim position.

20. The system of claim 15, wherein the trim position adjustment includes a run time for the trim actuator and wherein the trim actuator is controlled to trim up the marine drive based on the run time.

21. The system of claim 15, wherein the control system is configured to complete the steering position adjustment prior to initiating the trim position adjustment.

22. The system of claim 15, wherein the control system is configured to effectuate the trim position adjustment and the steering position adjustment simultaneously to force the marine drive toward a centered steering position as the trim position increases toward a maximum trim position.

* * * * *